United States Patent [19]

Durbut et al.

[11] Patent Number: 4,919,839

[45] Date of Patent: Apr. 24, 1990

[54] LIGHT DUTY MICROEMULSION LIQUID DETERGENT COMPOSITION CONTAINING AN ANIOCIC/CATIONIC COMPLEX

[75] Inventors: Patrick Durbut, Verviers, Belgium; Ammanuel Mehreteab, Piscataway, N.J.; Myriam Mondin, Seraing; Guy Broze, Grace-Hollogne, both of Belgium

[73] Assignee: Colgate Palmolive Co., Piscataway, N.J.

[21] Appl. No.: 313,664

[22] Filed: Feb. 21, 1989

[51] Int. Cl.[5] ..... C11D 1/65; C11D 3/43; C11D 17/08; C11D 11/00

[52] U.S. Cl. ..... 252/153; 252/173; 252/547; 252/548; 252/542; 252/DIG. 14; 252/DIG. 25; 252/171; 252/551; 252/552; 252/554; 252/DIG. 19; 8/137

[58] Field of Search ..... 252/121, 174.25, DIG. 14, 252/DIG. 5, 110, 153, 542, 552, 555, 104, 548, 8.75, 545, 173, 90, 546, 547, 171, 551, 554, DIG. 19

[56] References Cited

U.S. PATENT DOCUMENTS

| | | | |
|---|---|---|---|
| 2,950,255 | 8/1960 | Goff | 252/DIG. 5 |
| 3,044,962 | 7/1962 | Brunt et al. | 252/110 |
| 3,711,414 | 1/1973 | Hewitt | 252/DIG. 14 |
| 3,882,038 | 5/1975 | Clayton | 252/153 |
| 4,061,603 | 12/1977 | Rubinfeld | 252/555 |
| 4,101,456 | 7/1978 | Renaud et al. | 252/552 |
| 4,176,080 | 11/1979 | Wise et al. | 252/104 |
| 4,180,472 | 12/1979 | Mitchell et al. | 252/104 |
| 4,264,457 | 4/1981 | Beeks et al. | 252/548 |
| 4,272,395 | 6/1981 | Wright | 252/548 |
| 4,363,756 | 12/1982 | Seputreda et al. | 252/153 |
| 4,394,127 | 7/1983 | Melville | 252/90 |
| 4,576,729 | 3/1986 | Puszek et al. | 252/173 |
| 4,681,704 | 7/1987 | Bernardino et al. | 252/546 |
| 4,786,422 | 11/1988 | Kern | 252/174.25 |

FOREIGN PATENT DOCUMENTS

| | | | |
|---|---|---|---|
| 818419 | 7/1969 | Canada . | |
| 944653 | 4/1974 | Canada . | |
| 6055497 | 5/1981 | Japan | 252/545 |
| 1238896 | 10/1986 | Japan | 252/DIG. 14 |
| 873214 | 11/1959 | United Kingdom | 252/8.75 |
| 1116966 | 6/1968 | United Kingdom | 252/DIG. 14 |
| 1232698 | 5/1971 | United Kingdom | 252/DIG. 14 |

*Primary Examiner*—Dennis Albrecht
*Assistant Examiner*—J. Darland
*Attorney, Agent, or Firm*—Bernard Lieberman; Murray M. Grill; Robert C. Sullivan

[57] ABSTRACT

A light duty microemulsion liquid detergent composition, useful for removing greasy soils from surfaces with both neat and dilute forms of the detergent composition, includes a moderately water soluble complex of anionic and cationic surfactants, in which complex the anionic and cationic moieties are in essentially equivalent or equimolar proportions, an anionic detergent, a co-surfactant, an organic solvent and water. Preferably, the complex component is one in which the anionic and cationic moieties include hydrophilic portions or substituents, in addition to the complex forming portions thereof, the anionic detergent is a mixture of higher paraffin sulfonate and higher alkyl polyoxyethylene sulfate, the co-surfactant is a polypropylene glycol ether, a poly-lower alkylene glycol lower alkyl ether or a poly-lower alkylene glycol lower alkanoyl ester and the organic solvent is a non-polar oil, such as an isoparaffin, or an oil having polar properties, such as a lower fatty acid ester or a lower fatty alcohol ester.

Also within the invention are the described complex, preferably one of equimolar proportions of sodium $C_{12-14}$ alkyl diethoxy ether sulfate and $C_{12-14}$ alkyl-bis(2-hydroxyethyl) methylammonium halide, and processes for manufacturing the liquid detergent composition and for removing grease from laundry and hard surfaces by use of such a liquid detergent composition, especially in neat form, in which latter process significantly improved cleaning results, compared to that obtained when using control detergent compositions.

6 Claims, No Drawings

LIGHT DUTY MICROEMULSION LIQUID DETERGENT COMPOSITION CONTAINING AN ANIOCIC/CATIONIC COMPLEX

This application relates to a light duty microemulsion liquid detergent composition which is useful for removing greasy soils from substrates. More particularly, the invention relates to such a detergent composition which contains a complex of anionic and cationic surfactants, an anionic surfactant, a co-surfactant, an organic solvent and water, and which is useful to remove greasy deposits from surfaces, as from dishes, both in neat form and when diluted with water.

Synthetic organic dishwashing detergent compositions have long been produced commercially and light duty liquid detergent compositions of such type have enjoyed considerable success for hand washing of dishes. Such compositions are normally based on anionic detergents and are unbuilt. Although they are useful in normal dilutions in dishwater, they have not been satisfactorily effective when employed in neat form, as on a sponge, to remove heavy greasy deposits from hard surfaces, or as pre-spotters for laundry.

Comparatively recently it has been discovered how microemulsions can be made and it was learned that microemulsion cleaning compositions, which contain a surfactant, a cosurfactant, a lipophilic solvent and water are more effective cleaners than ordinary emulsions and surfactant solutions.

Complexes made by reacting anionic and cationic surfactants have been suggested as components of built and unbuilt synthetic detergent compositions. In some cases such complexes were said to be useful components of particulate detergent compositions but they have also been suggested for use in liquid preparations.

Prior to the present invention applicants' invented complexes had not been employed in microemulsion cleaners, and their desirable effects on such microemulsions, including improved cleaning of heavy greasy soils from hard surfaces when used in neat form, as on a sponge, had not been recognized. In accordance with the present invention a light duty microemulsion liquid detergent composition which is useful for removal of greasy soils from substrates, both in neat form and when diluted with water, comprises a complex of anionic and cationic surfactants, in which complex the anionic and cationic moieties are in essentially equivalent molar proportions, an anionic surfactant, a co-surfactant, an organic solvent, and water. Also within the scope of this invention are novel complexes, processes for manufacturing the light duty microemulsion liquid detergent compositions, and processes for use thereof, especially in neat form. Highly preferred complexes are those in which both the anionic and cationic surfactant reactants include hydrophilic substituents or components which modify the solubility in water of the complex so that it is about 35%. The microemulsion detergent compositions made with such complexes are of cleaning properties that are significantly superior to those of controls, especially when used in neat form, as on greasy dishes and utensils, or as laundry pre-spotter A search of selected prior art patents indicates that the present invention is novel and unobvious. U.S. Pat. No. 4,000,077 describes the use of anionic surfactant and cationic fabric softening agent in rinse water for softening washed laundry, and it is reported in the patent that the presence of the anionic surfactant (detergent) unexpectedly improves the softening of the laundry. However, this patent does not disclose the presence of a complex in a light duty microemulsion liquid detergent and does not disclose any improvements in cleaning hard surfaces when such a composition is employed in neat form. U.S. Pat. No. 4,264,457 discloses liquid detergent compositions that contain ethoxylated anionic and cationic surfactants with nonionic surfactant but these too are employed as fabric softeners and are not said to be in anionic-cationic complex form. U.S. patent application Ser. No. 06/916,067 discloses anionic/cationic surfactant complexes and their use in microemulsions for wash cycle fabric softening, and Ser. Nos. 06/916,068 and 06/916,069 also describe such complexes, but in particulate wash cycle fabric softening additives. However, none of these patent applications describes or suggests applicants' preferred complexes or their light duty microemulsion liquid dishwashing detergent compositions and none describes or suggests the unexpectedly beneficial removals of fatty soils resulting when such compositions are used, especially in neat form.

British patent specification No. 2,190,681 and U.S. patent application Ser. Nos. 07/120,250 and 07/267,872 disclose microemulsion cleaning compositions in concentrated and dilute forms, which comprise anionic synthetic organic surfactant, hydrocarbon solvent, cosurfactant and water, and which are intended for removing greasy soil from hard surfaces. However, such specification and applications do not disclose the presence in such microemulsions of applicants' complexes or other complexes of anionic and cationic surfactants, and do not disclose the unexpectedly beneficial removal of fatty soils from both hard surfaced items and from laundry by microemulsions containing such complexes.

The only prior art disclosure of anionic-cationic surfactant complexes being incorporated in any microemulsions that has come to the attention of applicants is that which is recited in an article by Bourrel, Bernard and Graciaa, that appeared in Tenside Detergents, Vol. 21, starting at page 311, which was published in 1984. That article does not suggest the presently disclosed light duty microemulsion liquid detergent compositions and their unexpectedly improved results. Rather, it appears to be an essentially theoretical study of the effect of an anionic-cationic surfactant reaction complex on microemulsion characteristics, and from that study the present compositions would not be obvious.

Pseudo-nonionic complexes of anionic and cationic surfactants are described in Vol. 125 (No. 2) Journal of Colloid and Interface Science, pages 602–609, which refers to ethoxylated sulfate surfactant reactants forming complexes with cationic surfactants, but the complexes made are not disclosed in microemulsions.

The anionic surfactants and the cationic surfactants which are reactable to form the complexes utilized in the invented compositions may be any such suitable reactant materials, although it is highly preferred to employ such surfactants which include one or more hydrophilic components other than the complex forming components thereof, so that the solubility in water of the complex resulting will be in the range of 5 to 70%, preferably 10 to 60%, more preferably 20 to 50%, e.g., about 35%. Descriptions of some operative anionic and cationic surfactants are found in U.S. patent application Ser. No. 07/916,067, which is incorporated herein by reference. Also incorporated herein by reference is the disclosure of U.S. Pat. No. 4,000,077, in which anionic and cationic surfactant reactants that can produce complexes are also described. Accordingly, the descriptions of such surfactant materials in this specification may be somewhat abbreviated.

The anionic surface active agents (or surfactants) will preferably be detergents and will normally include a lipophilic anionic moiety of relatively high molecular weight, which lipophile will preferably be or will include a long chain alkyl or alkenyl group of at least 10 or 12 carbon atoms, such as 10 or 12 to 18 or 20 carbon atoms. Such anionic detergent will also usually include a sulfonic, sulfuric or carboxylic acidic group, which, when neutralized, will be a sulfonate, sulfate or carboxylate, with the cation thereof preferably being alkali metal, ammonium or alkanolamine, such as sodium, ammonium or triethanolamine. Although the higher alkyls of such detergents may be of 10 to 20 carbon atoms, normally they will be of 12 to 18 carbon atoms, preferably 12 to 16 carbon atoms and more preferably 12 to 14 carbon atoms (which may be designated in this specification as $C_{12-14}$ alkyls).

Examples of operative anionic surfactants include sodium dodecylbenzene sulfonate; sodium linear tridecylbenzene sulfonate; potassium octadecylbenzene sulfonate; sodium lauryl sulfate; triethanolamine lauryl sulfate; sodium palmityl sulfate; sodium cocoalkyl sulfate; sodium tallowalkyl sulfate; sodium ethoxylated higher fatty alcohol sulfate, which will usually be of 1 to 20 ethylene oxide groups per mole, such as sodium lauryl monoethoxy ether sulfate, sodium lauryl diethoxy ether sulfate and sodium $C_{12-14}$ alkyl diethoxy ether sulfate; sodium $C_{14-17}$ paraffin sulfonate; sodium olefin sulfonate (of 10 to 20 carbon atoms in the olefin); sodium cocomonoglyceride sulfate; and sodium coco-tallow soap (1:4 coco:tallow ratio). Preferred anionic detergents for complexing with the cationic surfactants are the ethoxylated higher fatty alcohol sulfates, in which the salt forming cation is preferably alkali metal, more preferably sodium.

As with the anionic surfactants, the cationic surfactants useful to make the present complexes may be any suitable such compounds which react with the anionic surfactants to form the desired complexes. Preferable among such cationic surfactants are quaternary ammonium salts, in which at least one higher molecular weight group and two or three lower molecular weight groups are linked to a common nitrogen atom to produce a cation, and wherein the electrically balancing anion is a halide, acetate, nitrite or lower alkosulfate, such as bromide, chloride or methosulfate. The higher molecular weight substituent on the nitrogen is often a higher alkyl group, containing 10 or 12 to 18 or 20 carbon atoms and the lower molecular weight substituents may be lower alkyl of 1 to 4 carbon atoms, such as methyl and ethyl, which often are desirably substituted, as with hydroxy groups. One or more of said substituents may include an aryl moiety or may be replaced by an aryl, such as benzyl or phenyl. Among the possible lower molecular weight substituents are also lower alkyls of 1 to 4 carbon atoms, such as methyl and ethyl, which are substituted by poly-lower alkoxy moieties, such as polyethoxy moieties bearing a hydroxyl end group, and being of the general formula $R(X)_nOH$ wherein R is $C_{1-4}$ alkyl bonded to the nitrogen, X is $CH_2CH_2O$, $CH(CH_3)CH_2O$ or $CH_2CH_2CH_2O$, and n is from 1 to 20. Alternatively, one or two of such lower poly-lower alkoxy moieties, having terminal hydroxyls, may be directly bonded to the quaternary nitrogen instead of being bonded to it through the lower alkyl.

In addition to the cationic compounds previously mentioned, other suitable cationic surfactants include the imidazolinium salts, such as 2-heptadecyl-1-methyl-1-[(2-stearoylamido) ethyl]-imidazolinium chloride; the corresponding methyl sulfate compound; 2-methyl-1-(2-hydroxyethyl)-1-benzyl imidazolinium chloride; 2-coco-1-(2-hydroxyethyl)-1-octadecenyl imidazolinium chloride; 2-heptadecenyl-1-(2-hydroxyethyl)-1-(4-chlorobutyl) imidazolinium chloride; and 2-heptadecyl-1-(hydroxyethyl)-1-octadecyl imidazolinium ethyl sulfate. Generally, the imidazolinium salts of preference will be halides (preferably chlorides) and lower alkylsulfates (alkosulfates), and will include hydroxy-lower alkyl substituents.

The various anionic and cationic surfactants that are useful for making the novel and unexpectedly beneficial complexes of this invention will include hydrophilic moieties or substituents in one or both such surfactants so that the complex made will be of a moderate water solubility and of a desirable hydrophilic-lipophilic balance. In other words, one or both of the anionic and cationic surfactants should include sufficient hydrophilic function, apart from the sulfate, sulfonate or carboxylate of the anionic surfactant and apart from the halide or lower alkosulfate of the cationic surfactant, so that the complex will have moderate hydrophilic properties. Thus, the complex will be hydrophilic enough to form the desired microemulsions of the invention and yet, because it will not be excessively hydrophilic or water soluble, will still be lipophilic enough to promote oil solubilization in the microemulsion, thereby improving the capability of such microemulsion for removing heavy deposits of greasy soil from substrates.

It has been experimentally determined that when the solubility of the complex in water is in the range of 30 to 40% (30 to 40 g./100 g. of the aqueous solution), e.g., 35%, the microemulsions of this invention that are made will have a significantly improved capability of removing fatty soils from substrates. Broader ranges of operativeness are 20 to 50%, 10 to 60% and 5 to 70%. It is considered that solubility in water of the complex is more closely related to greasy soil removing capability than are hydrophilic-lipophilic balance numbers (HLB's) of such complexes.

To obtain the desired water solubility of the invented complex, hydrophilic moieties and hydrophilic substituents, such as ethylene oxide or glycols, glycosides and hydroxy-lower alkyls may be present in both the surfactant reactants that form the complex (but will not be the complex-forming groups or "heads" of such surfactants). Preferably, such hydrophilic groups will be ethylene oxide, hydroxy-lower ($C_{1-4}$) alkyl and/or hydroxy, in both the anionic and cationic surfactants. Excellent results have been obtained with ethylene oxide groups in the anionic surfactant and with hydroxyethyl groups in the cationic surfactant, but good results can also be obtained with only one of the surfactants being of such "hydrophilized" type. The ethylene oxide or ethylene glycol ether groups in the preferred anionic surfactants are desirably located in the otherwise lipophilic chain of such surfactant, which is normally a higher alkyl, and the hydroxyethyl groups are on the quaternary nitrogen of the cationic surfactant. Experimentation has established that excellent microemulsion forming and grease removal are obtained when the total of ethylene oxide and hydroxy-lower alkyl (hydroxyethyl) groups in the complex is about 4. Thus, such total is desirably in the range of 3 to 5 or 3 to 7 and more preferably two or more of such groups will be in each of the anionic and cationic moieties and often will be about equally divided between them. However, in some instances all of the hydrophilic moieties and substituents may be in either the anionic or the cationic surfactant reactant, but not in both. The number of hydrophilic substituents on the reactants can also be related to the number of carbon atoms in the hydrophilic chains of the reactants. Thus, four ethoxy groups satisfactorily hydrophilize 26 carbon atoms in such chains or the number of ethoxies may be about 15% of the number of lipophile carbon atoms, and suitable ranges are from 12 to 20% and 10 to 25%. A highly preferred complex is that of sodium lauryl diethoxyether sulfate and cocoalkyl-bis(2-hydroxyethyl) methylammonium chloride. Of course, similar combinations of surfactant reactants, such as sodium tetradecyl tetraethoxy ether sulfate and lauryl (2-hydroxypropyl) dimethylammonium chloride, and sodium linear tridecyl triethoxyether sulfate and myristyl-bis(2-hydroxybutyl) ethylammonium chloride may also be employed. The main consideration is that the complex resulting should be of both hydrophilic and lipophilic properties so that it will be of moderate solubility in water, and will form a satisfactory microemulsion and will effectively remove greasy soil from substrates when employed in neat form.

The anionic synthetic organic detergent component of the present microemulsion is one which is satisfactorily water soluble and stable in such microemulsions. Preferably it is a salt of an anionic detergent acid, which salt may be an alkali metal, ammonium or substituted ammonium salt, such as a sodium, potassium, ammonium or triethanolamine salt, or a mixture thereof. Such anionic detergent will normally include an essentially lipophilic long chain moiety and an acid moiety. Of the acids, sulfuric, sulfonic and carboxylic acids are preferred, and the long chain lipophile will normally be a higher linear alkyl or higher linear alkylbenzene. A preferred anionic detergent is sodium paraffin sulfonate wherein the paraffin is of 12 to 18 carbon atoms, preferably 14 to 17 carbon atoms. Preferably, a mixture of anionic detergents will be employed, with one being substantially more hydrophilic than the other. At least a portion of the total anionic detergent content will desirably be a detergent having one or more hydrophiles in the chain thereof. The higher alkyl of such detergent will normally be of a carbon content in the range of 10 to 20, preferably 12 to 18. The hydrophile in the chain will preferably be ethoxy and the salt forming cation will preferably be sodium. Thus, sodium higher alkyl ethoxy ether sulfate wherein the number of ethoxy groups present is in the range of 1 to 10, preferably 1 to 5, e.g., sodium $C_{12-14}$ alkyl diethoxy ether sulfate, is a preferred anionic detergent, and is the same as the anionic surfactant reactant that forms the desired complex, which appears to aid in production of stable and effective microemulsions. Although the described combination of anionic detergents is highly preferred it is within the invention to utilize others of the well known class of anionic detergents, and combinations thereof, including sodium linear tridecylbenzene sulfonate, sodium cocoalkyl monoglyceride sulfate, triethanolamine lauryl sulfate, potassium higher olefin sulfonate, and potassium cocate (soap), and hydrophilized modifications thereof.

In the anionic detergent portion of the invented microemulsions, when such detergent is a mixture of sodium $C_{14-17}$ paraffin sulfonate and sodium higher alkyl diethoxy ether sulfate, the proportion of such paraffin sulfonate to such ether sulfate will desirably be in the range of 3:2 to 5:1, preferably being in the range of 2:1 to 4:1 and most preferably being about 3:1. At such ratios, especially the most preferred ratio, excellent microemulsions are obtained, which exhibit desired grease removing effects when employed in neat form; when they are diluted in water such systems develop a desirable micellar structure and perform satisfactorily in dishwashing applications.

The co-surfactant of the present microemulsions, which significantly aids in the formation of such microemulsions, will be a polypropylene glycol of 2 to 18 propoxy units, a monoalkyl ether of a lower glycol or polyalkylene glycol of the formula $RO(X)_nH$, wherein R is $C_{1-4}$ alkyl, X is $CH_2CH_2O$, $CH(CH_3)CH_2O$ or $CH_2CH_2O$, and n is from 1 to 4, or a monoalkyl ester of the formula $R^1O(X)_nH$, wherein $R^1$ is $C_{2-4}$ acyl and X and n are as immediately previously described.

Representative members of the mentioned polypropylene glycol ethers include dipropylene glycol and polypropylene glycol having a molecular weight of 200 to 1,000, e.g., polypropylene glycol 400. Satisfactory glycol ethers and other glycol derivatives include diethylene glycol mono-n-butyl ether (butyl carbitol), dipropylene glycol mono-n-butyl ether, dipropylene glycol isobutyl ether, ethylene glycol monobutyl ether (butyl cellosolve), triethylene glycol monobutyl ether, tetraethylene glycol monobutyl ether, propylene glycol tertiary butyl ether, ethylene glycol monoacetate and dipropylene glycol propionate. Because it is capable of providing stable microemulsions over a broad range of temperatures, while avoiding any problems related to toxicity and/or environmental safety, another ether based on dipropylene glycol that is particularly preferred as a co-surfactant is dipropylene glycol monomethyl ether, which is commercially available.

The organic solvent component of the present microemulsions may include solvents that have polar properties, often in minor proportions, but the preferred organic solvent is a suitable oil, such as a non-polar oil, which is usually a hydrocarbon, of 6 to 16 carbon atom. Such hydrocarbon is normally a normal paraffin or an isoparaffin, and of these those of 10 to 12 carbon atoms are preferred, and most preferred are the $C_{10-11}$ isoparaffins. Such materials are available commercially from Exxon Corp. under the trade name Isopar H. In addition to such hydrocarbons, terpenes and similar perfume materials may be employed, as described in British patent specification No. 2,190,681, which was referred to earlier. Other useful hydrocarbons are heptane, octane and nonane but also included are those of cyclic structure, such as cyclohexane. Among other solvents that are useful are the $C_{1-6}$ acyl esters of $C_{1-18}$ alcohols, and/or the $C_{7-18}$ acyl esters of $C_{1-6}$ alcohols. Such compounds may be considered as representative of the groups of useful oils of polar properties, and are preferred in such group because of their similarity in structure to fats and oils that are intended to be removed from substrates by the invented composition.

In addition to the recited components of the compositions of the present invention there may also be present adjuvant materials for dishwashing and other detergent compositions, which materials may include foam enhancing agents, such as lauric myristic diethanolamide, foam suppressing agents(when desired), such as higher fatty acids and higher fatty acid soaps, preservatives and antioxidants, such as formalin and 2,6-ditert. butyl-p-cresol, pH adjusting agents, such as sulfuric acid and sodium hydroxide, perfumes, colorants, (dyes and pigments) and opacifying or pearlescing agents, if desired. Although sometimes small proportions of builder salts may be added to the present compositions for their building functions, normally such will be omitted because they tend to produce cloudy emulsions and can interfere with desired oil solubilizing properties of the microemulsion. In addition to the mentioned adjuvants, sometimes it may be desirable to include water soluble metal salts, such as chlorides and sulfates of magnesium and aluminum, to react with the anionic detergent to convert it to such a metal salt, which may improve performance of the invented compositions. However, such salts are not required components of such composition and normally work best at acidic or neutral pH's, if employed. The bivalent or multi-valent metal salts will normally not be present in any substantial excesses over their stoichiometric proportions with respect to the anionic detergent(s).

The proportions of the various components of the invented microemulsions will be chosen to obtain the desired properties in such compositions. Thus, the proportion of anionic detergent present will be a satisfactory cleaning proportion, sufficient, especially when the microemulsion is diluted, to release greasy (fatty) deposits found on dishes. The proportion of complex will be that which helps to form the microemulsion and which improves its capability for taking up a greasy soil, especially when the composition is applied neat to surfaces to be cleaned. The co-surfactant significantly helps the anionic detergent, aqueous medium and organic solvent to form a stable microemulsion. Water acts as the continuous medium for the microemulsion, and the organic solvent, very preferably a hydrocarbon, forms the dispersed phase of the microemulsion, which is in very finely divided form, and such oil effectively assists in incorporation in such dispersed phase of the greasy soil that the present compositions remove from dishes.

In percentages, the proportions of components for the invented microemulsion will usually be 1 to 10% of the complex, 20 to 40% of the anionic detergent, 1 to 5% of the co-surfactant, 1 to 5% of the organic solvent and 30 to 70% of water, with preferred ranges being 2 to 8%, 25 to 35%, 2 to 4%, 2 to 4% and 50 to 70%, respectively. A specific preferred formula includes about 5% of the complex, about 28% of the anionic detergent, about 2.5% of the co-surfactant, about 2.5% of the organic solvent and about 62% of water (when no adjuvants are present). Any adjuvant(s) present will normally not exceed 10%, preferably will be limited to 5%,and more preferably are held to 1 or 2%.

In the anionic detergent component(s) of the formula it will normally be desirable to include a mixture of different anionic detergents, one of which will include hydrophilic moieties or substituents in/on the lipophilic chain thereof. Preferably, such "hydrophilized" anionic detergent will be 1/5 to 1/1 of the content of the other "non-hydrophilized" anionic detergent. In other words, the proportion of paraffin sulfonate or other such anionic detergent to "hydrophilized" anionic detergent will be in the range of 1:1 to 5:1, preferably 2:1 to 4:1 and more preferably about 3:1, e.g., 3:1. Such ratios are desirable so that the final microemulsion is of improved stability and cleaning action against greasy soils when applied in neat form. In diluted form, such ratios also result in improved performances. Also important for the same reasons is the proportion of total anionic detergent:complex, which will normally be in the range of 2:1 to 25:1, preferably 4:1 to 10:1, and more preferably is 6:1. On a 100 parts basis, 75 to 95 parts of the anionic detergent mixture will be present with 5 to 25 parts of the complex, and a preferred composition will include 85 to 15 parts, respectively.

The solvent (oil) content will rarely exceed 10% but in some situations higher proportions can be incorporated and the microemulsions made will be stable and useful, especially in neat form. The proportion of co-surfactant to solvent is relevant to cleaning and stability of the invented microemulsions and it is desirable for that ratio to be in the range of 1:4 to 4:1, preferably 1:2 to 2:1.

To make the invented microemulsions various techniques may be employed. However, in almost all of these it is desirable to added the solvent component last, at which time the desired microemulsion will usually form spontaneously at about room temperature (20° C.) or at elevated temperature (usually up to 50° or 60° C.). Any adjuvants that are present may be added before or after microemulsion formation, sometimes depending on their nature, but in many cases it will not matter when they are added, because the order of addition will have little effect on the microemulsion, which is thermodynamically stable. Desirably, to make the present emulsions a solution will first be made of the synthetic detergent(s) in water and the co-surfactant will be dissolved in such solution. Following a different procedure, the co-surfactant may be added first, followed by the anionic detergent(s). The complex, which may have been made previously by reaction of the anionic and cationic surfactant, either in aqueous medium, or in molten state, may then be added and the organic solvent, preferably a hydrocarbon, may then be admixed to form the microemulsion. Alternatively, the complex may be made in aqueous solution or by reacting the surfactant components in molten state and may be admixed with the water, anionic detergent(s) and co-surfactant, followed by admixing in of the organic solvent. It is also possible and very often preferable to react the cationic surfactant in formula amount of water with excess ethoxylated anionic detergent and then admix the non-ethoxylated anionic detergent, co-surfactant and oil. It is not normally considered to be desirable to react the anionic and cationic surfactants in the presence of other components of the final microemulsion composition, and the presence of any non-hydrophilized anionic detergent will especially be avoided.

The microemulsions made and utilized in the present invention are of the oil-in-water type, in which a lipophilic liquid phase is dispersed in a continuous hydrophilic phase in the presence of the anionic surfactant, anionic-cationic complex and co-surfactant. The dispersed phase is in the form of droplets or particles with an average diameter no more than 3,200Å, typically being between 100 and 1,000 angstroms. Some microemulsions containing both lipophilic and hydrophilic components also can form mesomorphic arrangements, the order of which does not persist for longer distances than about 0.16 micron. When the elementary structural entities of the dispersed phase (swollen micelles) are of an average diameter greater than 3,200Å the liquid composition is no longer a microemulsion but is an emulsion, which can often be turbid and thermodynamically unstable (whereas the microemulsion is clear and very often is thermodynamically stable). When such elementary structural entities of the dispersed phase are below about 40Å a true (but not necessarily ideal) solution is present. Thus, the dispersed phase in the present microemulsions is one wherein the elementary structural entities are of an average diameter in the range of 40 to 3,200Å, typically 100 to 1,000Å.

The present microemulsions are clear and stable in neat form and are capable of being diluted with water to normal dishwashing concentrations without impairing the micellar dispersion of the organic solvent. Because the microemulsion form increases the surface area of the lipophilic constituent it is considered that it contributes significantly to the utility of the present compositions in neat form. It is also important that the micellar dispersion form be maintained for use when diluted with water. The surfactant, co-surfactant, solvent and water are important to produce a microemulsion. The presences of the anionic surfactant or detergent (especially the combination of ethoxylated and non-ethoxylated anionic detergents), moderately water soluble complex and co-surfactant all help to form and maintain a highly stable microemulsion. Additionally, the presence of the complex significantly improves the capability of the microemulsion, in neat form, to remove fatty deposits from substrates, whether such are hard surfaces, such as those of dishes, or soft surfaces, such as those of laundry. All the recited components coact with each other in the proportions mentioned to produce a microemulsion composition of improved and desired properties. In such compositions the proportion of water is the greatest, followed by that of the anionic detergent (mixture) and those of complex, co-surfactant and solvent, which are less than that of the anionic detergent(s).

The present compositions may be successfully employed without dilution to remove extremely heavy deposits of greasy fats and oils from dishes, pans and other hard surfaces, before normal hand dishwashing in a dishpan or sink, or they may be employed to "dissolve" soils in pre-spotting treatments of laundry items that have been stained with greasy soils. Previously, light duty liquid detergent compositions based on anionic detergents were notably deficient as pre-spotting agents. Thus, the present microemulsions are the first light duty liquid detergents that are useful in neat form as cleaners for hard surfaces and as laundry pre-spotters, and are useful in diluted form for hand (non-machine) dishwashing. They can be applied in neat form to extremely greasy dishes, roasting pans with baked on greasy deposits and residues, ovens, greasy kitchen range hoods and tiles, and greasy walls, to remove greasy deposits from them. Applications may be by means of a sponge or cloth, or by soaking, for the more adherent deposits. Dilute forms of the invented microemulsions may be employed and will still be microemulsions, with that term indicating that the organic solvent remains disposed inside the micelles. In dilute form one part of the invented microemulsion may be diluted with about 1 to 1,000 parts of water so that the concentration thereof will be in the range of 0.1 to 50%, but preferably the concentration will be in the range of 0.1 to 10%, and more preferably 0.1 to 1% for ordinary hand dishwashing, and excellent cleaning of dishes will be obtained, similar to that of commercial dishwashing detergent compositions. Such excellent cleaning of dishes is even obtainable in hard water (300 p.p.m., as $CaCO_3$). The concentration will preferably be in the range of 0.1 or 1 to 100%, more preferably 10 to 100%, for pre-spotting of greasy stains on laundry, for removing thick greasy deposits from dishes and other hard surfaces by sponging, and for soaking baked-on greasy deposits and chars to remove them from hard surfaces. For such various cleaning applications the temperature of the microemulsion or the dilute microemulsions will normally be in the range of 15° to 90° C., preferably 20° to 70° C., and often will be in the range of 20°, 25° or 30° to 40° or 50° C., especially for hand dishwashing. To assist in cleaning of baked-on greasy deposits from items, such as from roasting or frying pans, after soaking, such items may be rubbed with plastic (nylon), metal mesh or steel wool scrubbing pads to speed removals of the deposits from them.

The advantages of the invention have been referred to previously and some have been described in some detail, but a fuller description follows. The present microemulsions include an anionic detergent as the primary detersive component but although such anionic liquid detergent is an excellent dishwashing detergent in dilute form, it had previously usually been ineffective in concentrated or neat form. However in the present compositions it is effective when employed as is. This is attributable to both its microemulsion form and the presence of the anionic-cationic surfactant complex, which, although essentially lipophilic in nature, is still hydrophilic enough (being of limited or moderate water solubility) not to significantly adversely affect the detergency of the anionic detergent in the composition. The presence of the complex, together with the co-surfactant and solvent or oil, does significantly improve the grease removing power of the invented microemulsion liquid detergent when it is employed in concentrated form. The invented microemulsion composition also has a greater capacity for solubilizing greasy soils, such as triolein (the standard test fat/oil), and dissolves them faster than do the conventional anionic detergent of equivalent active ingredient (A.I.) content.

The preferred compositions of the invention are superior in cleaning power to similar compositions in which the anionic and cationic surfactants (like sodium lauryl sulfate and cetyl trimethyl ammonium bromide) that react to form a complex are more hydrophobic or lipophilic in nature. Although such "control" compositions can be of similar stability and properties with respect to oil solubilization capacity and time for effecting such solubilization, in neat form, the microemulsions containing such more hydrophobic or lipophilic control complexes, which actually behave like oils, being structurally equivalent to larger hydrocarbon molecules, as a first approximation, are less useful as cleaning agents when in diluted form (see Example 4).

To sum up, the invented compositions are better than prior art and control compositions with respect to the sum of cleaning power in neat form, cleaning ability in dilute form, and stability . Because the microemulsion state is important to the success of the invented compositions as cleaning agents, better stability results in better cleaning, in addition to the desirable effect on appearance that is obtained by maintaining the compositions in microemulsion form.

The following examples illustrate but do not limit the invention. Unless otherwise indicated all parts are by weight and all temperatures are in °C. in such examples and elsewhere throughout this specification, and in the claims.

EXAMPLE 1

| EXAMPLE 1 | |
|---|---|
| Components | Percent (by weight) |
| ETHOQUAD C/12 (Akzo Chemical Co.) coco-bis(2-hydroxyethyl) methylammonium chloride (75% active ingredient [A.I.]) | 3.12 |
| TEXAPON N70 (Henkel & Cie.) sodium lauryl ether sulfate having 2 ethoxy units per mole (70% A.I.) | 13.87 |
| MARLON PS 60 (Huls AG) sodium $C_{14-17}$ paraffin sulfonate (60% A.I.) | 35.33 |
| DOWANOL DPM (Dow Chemical Corp.) dipropylene glycol monomethyl ether (100% A.I.) | 2.50 |
| ISOPAR H (Exxon Corp.) $C_{10-11}$ isoparaffin (100% A.I.) | 2.50 |
| Adjuvants (dye, perfume, preservative) | q.s. |
| Water | balance |
| | 100.00 |

A light duty liquid detergent in microemulsion form is made by dissolving the Ethoquad C/12 and the Texapon N70 in approximately equal proportions of the water and then mixing such aqueous solutions at about room temperature (25° C.) to form the corresponding cationic-anionic surfactant complex in water containing the excess of Texapon N70. (Both the Ethoquad C/12 and Texapon N70 are of similar higher alkyl groups, with the cocoalkyl of the Ethoquad C/12 and the "lauryl" of the Texapon N70 being $C_{12-14}$ alkyls). The Marlon PS 60 is admixed with the complex and excess Texapon N70 (in water), followed by additions of the Dowanol DPM and the adjuvants (which are desirably pre-dissolved in small proportions of the water component). Subsequently, the Isopar H is admixed and the microemulsion is formed spontaneously. (The adjuvants, which will total less than 1% of the product, may be admixed at any suitable time before the Isopar H, and sometimes may be added afterward). The microemulsion is clear.

The microemulsion formed is employed to remove beef fat deposits from dishes, greasy and sooty deposits from painted walls, and oily stains from work clothes in prespotting operations, prior to normal automatic washing of laundry, and is found to be very satisfactory in such applications, being unexpectedly better than aqueous control compositions of the same and even greater concentrations of anionic detergent, such as over 33%, on an A.I. basis. It is also effective in softening burnt-on greasy soils on ovens and on roasting pans so that such are more readily removed by rubbing with a cleaning pad. Furthermore, when the invented microemulsion is diluted with water to a normal washing concentration of 1.25 g./l., it is found to be excellent for hand washing of dishes, being as effective as commercially successful light duty liquid detergents in such applications.

EXAMPLE 2

The cationic/anionic complex of Example 1 is made by reacting aqueous solutions of the Example 1 surfactant reactants, with the amounts of surfactants present being 2.34 parts and 2.65 parts, respectively, on a 100% A.I. basis (or 3.12 parts and 3.79 parts, respectively, on an "as is" basis). The reaction is carried out at about 25° C. and the product is a moderately water soluble complex of the cationic and anionic surfactants which dissolves to the extent of about 35% (35 g./100 g. of solution). 7.06 Parts of the sodium lauryl ether sulfate (or10.09 parts of Texapon N70) and 21.20 parts of the paraffin sulfonate (35.33 parts of Marlon PS 60)are dissolved in water and are mixed with the complex, including the water from the reactant solutions, after which the co-surfactant, adjuvants and solvent are admixed, as in Example 1. The result is a light duty microemulsion liquid detergent composition like that of Example 1, with the same properties.

In one change in the manufacturing procedure, the cationic and anionic surfactant reactants are melted, in the presence of an ionizing proportion of water, and are reacted in such molten state, after which the complex made is mixed with the aqueous solution of anionic detergents, which solution contains the formula proportion of water, and the other components are subsequently admixed with the resulting solution.

When tested in the manner described for the microemulsion of Example 1, similar results are obtained.

EXAMPLE 3

(Comparative)

A control laboratory test was run, in which the invented light duty microemulsion liquid detergent composition of Example 1 (that of Example 2 could be used interchangeably) was compared for fat solubilization characteristics with a control light duty liquid detergent composition containing 24.94% (A.I. basis) of sodium $C_{14-17}$ paraffin sulfonate and 8.31% (also on an A.I. basis) of sodium $C_{12-14}$ alkyl diethoxy ether sulfate, which control is essentially like commercial dishwashing detergent compositions. The control detergent composition includes more of the mentioned anionic detergents than the experimental composition to compensate for the omission of the complex, and the co-surfactant and solvent are omitted In the test run incremental quantities of triolein, (glycol trioleate), a standard test fat, are added to the compositions being tested, which are at 25° C., with controlled agitation, until saturation thresholds are observed (when the solutions turn turbid). Times required to solubilize each increment of triolein are recorded so that a "kinetic curye" can be drawn. However, because the differences between the solubilizing properties of such compositions are so great, such comparative curves will not be given here, it being considered sufficient to state that 100 grams of the experimental composition solubilized 6.4 grams of triolein in 72 minutes whereas 100 grams of the control composition took three hours to solubilize 1.8 grams of triolein. The experimental composition took only 12 minutes to solubilize 1.8 grams of triolein, clearly establishing that the experimental formula much more rapidly solubilizes the triolein and has a greater capacity for solubilizing it, than does the control.

The laboratory data given above indicate that the invented compositions will function much more effectively in neat form as pre-spotters to remove oily stains from laundry, and as cleaners for walls, ovens, baking pans and other hard surfaces which may contain deposits of fatty materials, compared to control light duty liquid detergent compositions, when both are employed in neat form. Such laboratory results are confirmed by comparative testings of the experimental and control compositions in the applications described above.

Comparative testings of the described experimental and control compositions to determine dishwashing characteristics were also carried out. In such tests, a standardized greasy soil solution is sprayed uniformly on test substrates (white Formica® tiles) and allowed to dry at room temperature for 30 minutes, after which they are tested, employing a Gardner® Testing Machine, which applies a moistened sponge containing a measured amount of light duty liquid detergent composition to such tile, in reciprocating strokes. The strokes are counted until a path has been cleared by the sponge through the soiled area on the tile. An oil soluble dye in the greasy soil facilitates noting of such endpoint. Based on testing experience a difference of five strokes for compared detergent compositions is significant.

In the test described the experimental formula cleared a path through the soiled area after seven strokes whereas the control composition required 18 strokes, showing clear superiority in such dishwashing applications for the experimental formula. Such result is confirmed by actual hand dishwashing comparisons by experienced testers.

EXAMPLE 4

(Comparative)

This example compares hand dishwashing capabilities of the preferred experimental light duty microemulsion liquid detergent composition of Example 1 with a "control" composition which is like it in all respects except that the complex is made from 2.65% of sodium lauryl sulfate and 2.34% of cetyl trimethyl ammonium bromide, both percentages being on an A.I. basis. The microemulsions made are tested for dishwashing capability by a laboratory test that has been proven to be accurate. In such test the light duty liquid dishwashing detergent composition is dissolved in water of 300 p.p.m., hardness, as $CaCO_3$, to the extent of 1.25 g./l., with the water being at a temperature of about 35° C. The solution of dishwashing detergent is subjected to a controlled mechanical action and such agitation is continued throughout the test, while a standard greasy soil (Crisco® shortening) is added to the "dishwater". The end point is that amount of such grease which causes disappearance of the foam on the surface of the water. Such amount is correlatable with the number of dishes (mini-plates) which can be satisfactorily washed by the detergent composition being tested.

For the (experimental) microemulsion of Example 1 this test indicates that 43 mini-plates can be washed satisfactorily whereas the "control" microemulsion containing the "control" complex can wash only 28 mini-plates. Experience has indicated that a difference of about four mini-plates is significant and therefore it is clear that the experimental microemulsion is significantly better for washing greasy deposits from dishes than is the "control" composition. Such results are verifiable by actual use testing and are attributed to the presence in the invented compositions of the complex, which includes enough "hydrophilized" substituents or moieties so that it is moderately water soluble. Similar results are obtainable when other such moderately water soluble complexes are employed in the present formulations, such as those of 3 or 5 hydroxyethyl or oxyethyl groups in the complex, and wherein the total number of carbon atoms in the lipophilic groups is in the range of 24 to 32.

EXAMPLE 5

The fat solubilization characteristic test of Example 3 was run on four detergent compositions which are variations of the Example 1 formula, but in all cases adjuvants were omitted. Such formulas are given below, with all percentages being on an A.I. basis.

| Components | Percent (by weight) | | | |
|---|---|---|---|---|
| | A | B | C | D |
| Coco-bis(2-hydroxyethyl) methylammonium chloride | — | 2.34 | — | 2.34 |
| Sodium lauryl diethoxy ether sulfate | 8.31 | 9.71 | 8.31 | 9.71 |
| Sodium $C_{14-17}$ paraffin sulfonate | 24.94 | 21.20 | 24.94 | 21.20 |
| Dipropylene glycol monomethyl ether | — | — | 5.00 | 5.00 |
| $C_{10-11}$ isoparaffin | — | — | 5.00 | 5.00 |
| Water | balance | balance | balance | balance |
| | 100.00 | 100.00 | 100.00 | 100.00 |

In the formulas of Columns B and D the complexes are made by the reaction of 2.34 parts of the cationic surfactant with 2.65 parts of the sodium lauryl diethoxy ether sulfate. Thus, the formula of Example 5B differs from that of Example 5A by including applicants' preferred complex and Formula 5D differs from Formula 5C in the same manner.

In the laboratory the products of the four formulas were tested for oil holding capacity and it was found that such capacities were 1.8, 1.3, 3.6 and 4.6 g./100 g. of neat liquid detergent composition, respectively. These data show that in the invented microemulsions, which contain the described complex, co-surfactant and solvent, the combination of components causes a surprising increase in soil solubilization by the neat detergent compositions, which makes them more effective as pre-spotting agents and for removing heavy deposits of fatty soils from hard surfaces. Note that the data indicate that one would expect a diminution in oil holding capacity because Formula 5B holds less oil than Formula 5A, but surprisingly, in the invented microemulsion (of Formula 5D), the oil holding capacity is increased over that of the 5C formula. Such ability of the neat microemulsion in the present invention to remove fatty soils from surfaces can be verified by actual comparative testing for pre-spotting and cleaning characteristics of the respective formulas.

EXAMPLE 6

In variations of the formula of Example 1 different complexes within the invention, having 3 to 6 hydrophilizing groups, as described in this specification, are substituted for the Example 1 complex, other ethoxylated anionic detergents, described in this specification, are employed in place of the sodium lauryl ether sulfate and other anionic detergents, described in this specification, are substituted for the $C_{14-17}$ paraffin sulfonates, and essentially the same types of results are obtainable. When proportions of the components are varied ±10, ±20 and ±30%, while remaining within the ranges given in this specification, the resulting microemulsions will also have the desirable properties described for compositions like that of Example 1. Similarly, other co-surfactants may be substituted and other solvents may be employed, as were described, and in the different proportions previously mentioned, and similar good results are obtained.

In further variations of the invention the solubility in water of the complex may be adjusted by utilizing mixtures of complexes in the specification, with some being more hydrophilic and some being more lipophilic than that illustrated. In variations, although not preferred, the desired water solubility of the complex may be obtained by mixing complexes which are of greater and lesser water solubilities than the desired complexes of this invention, with some or all being too water soluble or not water soluble enough. Of course, in all such instances one of skill in the art will understand how to make the operative compositions within the present invention, with their characteristics, and excessive experimentation is not required.

In the foregoing description and claims when components of the invented compositions are mentioned in the singular it is to be considered that mixtures are within such descriptions.

The invention has been described with respect to various examples, illustrations and embodiments thereof but is not to be limited to these because it is evident that one of skill in the art, with the present specification before him/her, will be able to utilize substitutes and equivalents without departing from the invention.

What is claimed is:

1. A light duty microemulsion liquid detergent composition which is useful for removal of greasy soils from substrates, both in neat form and when diluted with water, which comprises 1 to 10% of a complex of sodium $C_{12-18}$ alkyl diethoxy ether sulfate and $C_{12-14}$ alkyl-bis(2-hydroxyethyl) methylammonium halide, in which such anionic and cationic surfactants are in essentially equivalent proportions, 20 to 40% of an anionic detergent, which is a mixture of sodium $C_{12-18}$ paraffin sulfonate and sodium $C_{12-18}$ alkyl diethoxy ether sulfate, in which the proportion of such paraffin sulfonate to such alkyl diethoxy ether sulfate is in the range of 2:1 to 4:1, 1 to 5% of a co-solvent which is dipropylene glycol monomethyl ether, 1 to 5% of an organic solvent which is a $C_{10-12}$ isoparaffin, and 30 to 70% of water, in which composition the ratio of anionic detergent to complex is in the range of 2:1 to 25:1.

2. A liquid detergent composition according to claim 1 wherein the complex is of sodium lauryl diethoxy ether sulfate and coalkyl-bis-(2-hydroxyethyl) methylammonium ammonium chloride, which complex is about 35% soluble in water, the anionic detergent is a mixture of $C_{14-17}$ paraffin sulfonate and sodium $C_{12-14}$ alkyl diethoxy ether sulfate in about 3:1 proportion, and the proportion of complex to anionic detergent mixture is in the range of 5 to 25 parts of complex to 75 to 95 parts of anionic detergent mixture.

3. A liquid detergent composition according to claim 2 which comprises about 5% of the complex, about 28% of the anionic detergent, which includes about 21% of sodium $C_{14-17}$ paraffin sulfonate and about 7% of sodium $C_{12-14}$ alkyl diethoxy ether sulfate, about 2.5% of dipropylene glycol monomethyl ether and about 2.5% of $C_{10-11}$ isoparaffin, with the balance being water and adjuvants, if any.

4. A process for manufacturing a light duty microemulsion liquid detergent composition which is useful for removal of greasy soils from substrates, both in neat form and when diluted with water, which composition comprises 1 to 10% of a complex of sodium $C_{12-18}$ alkyl diethoxy ether sulfate and $C_{12-14}$ alkyl-bis(2-hydroxyethyl) methylammonium halide, in which such anionic and cationic surfactants are in essentially equivalent proportions, 20 to 40% of an anionic detergent, which is a mixture of sodium $C_{12-18}$ paraffin sulfonate and sodium $C_{12-18}$ alkyl diethoxy ether sulfate, in which the proportion of such paraffin sulfonate to such alkyl diethoxy ether sulfate is in the range of 2:1 to 4:1, 1 to 5% of a co-solvent which is dipropylene· glycol monomethyl ether, 1 to 5% of an organic solvent which is a $C_{10-12}$ isoparaffin, and 30 to 70% of water, in which composition the ratio of anionic detergent to complex is in the range of 2:1 to 25:1, which process comprises reacting the anionic and cationic surfactants, in liquid state, to make the complex, after which the complex is mixed with the other components of the liquid detergent composition, with the $C_{10-12}$ isoparaffin being added last to the mixture of the other such components.

5. A process according to claim 4 wherein the reaction of the anionic and cationic surfactants is conducted at a suitable temperature at which both such reactants are dissolved in water or are in melted form.

6. A process according to claim 4 wherein the anionic and cationic surfactants are dissolved in water when they are reacted to form the complex, and the complex so made, in such water solution, is mixed with the anionic detergent, co-surfactant and solvent, with the solvent being the last of the components to be mixed with the others, whereby the microemulsion forms spontaneously.

* * * * *